US009114401B2

(12) United States Patent
Dumont

(10) Patent No.: US 9,114,401 B2
(45) Date of Patent: Aug. 25, 2015

(54) GRINDING PROCESS AND UNIT, AND CORRESPONDING PRODUCTION PROCESS OF A HYDRAULIC BINDER

(71) Applicant: LAFARGE, Paris (FR)

(72) Inventor: Didier Dumont, Four (FR)

(73) Assignee: LAFARGE, Paris (FR)

( * ) Notice: Subject to any disclaimer, the term of this patent is extended or adjusted under 35 U.S.C. 154(b) by 0 days.

(21) Appl. No.: 14/365,041

(22) PCT Filed: Nov. 30, 2012

(86) PCT No.: PCT/EP2012/074029
§ 371 (c)(1),
(2) Date: Jun. 12, 2014

(87) PCT Pub. No.: WO2013/087421
PCT Pub. Date: Jun. 20, 2013

(65) Prior Publication Data

US 2014/0345497 A1 Nov. 27, 2014

(30) Foreign Application Priority Data

Dec. 16, 2011 (EP) ..... 11306684
Dec. 16, 2011 (EP) ..... 11306685

(51) Int. Cl.
*B02C 23/32* (2006.01)
*B02C 23/14* (2006.01)
(Continued)

(52) U.S. Cl.
CPC ..... *B02C 23/14* (2013.01); *B02C 15/001* (2013.01); *B02C 17/00* (2013.01); *B02C 21/007* (2013.01);
(Continued)

(58) Field of Classification Search
CPC ..... B02C 23/08; B02C 23/10; B02C 23/12; B02C 23/14
USPC ..... 241/78, 79, 79.1, 29, 24.1, 152.1, 152.2
See application file for complete search history.

(56) References Cited

U.S. PATENT DOCUMENTS 4,036,441 A * 7/1977 Basten et al. ..... 241/20
4,245,999 A * 1/1981 Reiniger ..... 241/41
4,597,537 A 7/1986 Misaka et al.

FOREIGN PATENT DOCUMENTS

CA 2 701 139 4/2009
CA 2 701 331 4/2009
(Continued)

OTHER PUBLICATIONS

International Search Report issued for International Application No. PCT/EP2012/074029, dated Mar. 22, 2013.
(Continued)

*Primary Examiner* — Faye Francis
(74) *Attorney, Agent, or Firm* — Pillsbury Winthrop Shaw Pittman LLP

(57) ABSTRACT

A grinding process, in a grinding unit including a first shop including a first mill and a first separator, an outlet from the first mill being connected to an inlet of the first separator; a second shop including a second separator and a second mill, an outlet from the second separator being connected to an inlet of the second mill; the second separator being fed by the material coming from the first separator, wherein the first separator is operated at a tangential speed of 15 to 25 m/s and a radial speed of 3.5 to 5 m/s; and the second separator is operated at a tangential speed of 20 to 50 m/s and a radial speed of 2.5 to 4 m/s.

14 Claims, 4 Drawing Sheets

(51) Int. Cl.

| | |
|---|---|
| ***B02C 23/10*** | (2006.01) |
| ***B02C 23/08*** | (2006.01) |
| ***B02C 15/00*** | (2006.01) |
| ***B02C 17/00*** | (2006.01) |
| ***B02C 21/00*** | (2006.01) |
| ***B02C 23/12*** | (2006.01) |

(52) U.S. Cl.
CPC ..... *B02C 23/08* (2013.01); *B02C 23/10* (2013.01); *B02C 23/12* (2013.01); *B02C 2015/002* (2013.01)

(56) References Cited

FOREIGN PATENT DOCUMENTS

| | | |
|---|---|---|
| DE | 42 24 704 | 1/1994 |
| FR | 2 098 038 | 3/1972 |
| FR | 2 901 268 | 11/2007 |
| FR | 2 921 358 | 3/2009 |
| FR | 2 943 662 | 10/2010 |
| FR | 2 970 962 | 8/2012 |
| GB | 783 113 | 9/1957 |
| GB | 819 957 | 9/1959 |
| GB | 937 419 | 9/1963 |
| GB | 1 324 770 | 7/1973 |

OTHER PUBLICATIONS

Schnatz, R., "Optimization of continuous ball mills used for finish-grinding of cement by varying the L/D ratio, ball charge filling ratio, ball size and residence time," Int. J. Miner. Process, vol. 74S, 2004, pp. S55-S63.

International Preliminary Report on Patentability issued for International Application No. PCT/EP2012/074029, dated Jun. 26, 2014.

* cited by examiner

GRINDING PROCESS AND UNIT, AND CORRESPONDING PRODUCTION PROCESS OF A HYDRAULIC BINDER

CROSS-REFERENCE TO RELATED APPLICATIONS

This is the U.S. National Stage of PCT/EP2012/074029, filed Nov. 30, 2012, which in turn claims priority to European Patent Application No. 11306684.9, filed Dec. 16, 2011 and European Patent Application No. 11306685.6, filed Dec. 16, 2011, the entire contents of these applications are incorporated herein by reference in their entireties.

The present invention relates to the field of grinding, and in particular the grinding of raw materials used for the production of hydraulic binders.

Grinding of different raw materials is a known process, as well as the equipment and units making it possible to grind different raw materials. However, requirements in terms of grinding have changed and in particular, there is a trend to grind different materials more and more finely, in particular in the field of hydraulic binders.

The fineness of a material may be characterised by a curve called the particle size distribution curve, which represents the evolution of the volume percentage of the particles according to the average size of the particles. A particle size distribution curve generally has a shape of the Gauss type of curve, which is to say a curve with a bell shape.

Therefore, a particle size distribution curve increases until a maximum volume percentage, then it decreases. A particle size distribution curve is more or less spread out around the average size of the particles, which corresponds to the maximum volume percentage. A particle size distribution curve is considered to be centred when it is not very spread out on either side of the average size of the particles, which corresponds to the maximum volume percentage.

The spread of a particle size distribution curve can, for example, be evaluated by the Rosin Rammler (nRR) slope. The Rosin Rammler slope can be determined by tracing a curve representing the evolution of the sieve residue, on a logarithmic scale, according to the size of the particles. The obtained curve is almost a line. The slope of this line is the Rosin Rammler slope.

In order to obtain a centred particle size distribution curve it is desirable to have a Rosin Rammler slope greater than or equal to 1.2, preferably as high as possible.

It may be difficult to obtain a centred particle size distribution curve when a finely ground material is desired. For example, a typical particle size distribution curve has a Rosin Rammler slope of 0.8 to 1.1. A Rosin Rammler slope greater than or equal to 1.2 would be more satisfactory.

It is not possible to obtain materials having a centred particle size distribution curve for a Blaine Specific Surface greater than or equal to 7000 $cm^2/g$ using existing grinding processes and associated equipment.

In order to respond to the requirements of industrialists and in particular to cement producers, it has become necessary to find another means of obtaining ground materials having a centred particle size distribution curve for a Blaine Specific Surface greater than or equal to 7000 $cm^2/g$.

Therefore, the problem which the invention intends to solve is to provide a new means to grind at least one material, and in particular a material used for the production of hydraulic binders, in order to obtain a ground material having a Rosin Rammler slope greater than or equal to 1.2, preferably as high as possible, and a Blaine specific surface greater than or equal to 7000 $cm^2/g$.

Unexpectedly the inventors have shown that it is possible to use, to grind a material more finely, and in particular a material used for the production of hydraulic binders, a grinding process with a unit comprising a first mill associated with a first separator, and a second separator associated with a second mill, the radial speed and the tangential speed of the first and second separators being selected so that the final ground material has a Blaine Specific Surface greater than or equal to 7000 $cm^2/g$ and/or a Rosin Rammler slope greater than or equal to 1.2.

Generally, a separator comprises a fixed cylindrical enclosure on a vertical axis, in which a rotating cage and vanes are placed. The vanes are placed in a circle around the rotating cage. They extend over the entire height of the rotating cage. The rotating cage comprises blades fixed between the massive bottom disk and a hollow top disk. Each blade is radially oriented in a substantially vertical direction over the entire height of the rotating cage. The space located between the blades of the rotating cage and the vanes is called the selection zone. The space located between the cylindrical enclosure and the vanes is called the feeding zone of gas and particles of a material to be separated. A gas passes through a separator, in particular, to carry the particles of a material to be separated. The rotating cage is a cylinder, having a height and a diameter, which turns around itself along the vertical axis of the rotating cage. The vanes can be oriented, rotating around themselves, to adjust the speed of the gas to the rotation speed of the rotating cage. The gas, which carries the material to be separated arrives by the bottom of the separator in the feeding zone and rises vertically. It is diverted by the vanes, in order to pass the selection zone and reach the blades of the rotating cage by a radial movement, then it resumes its vertical rising movement in the centre of the rotating cage.

The radial speed is the displacement speed, through the selection zone of the separator, of the gas used to carry the particles of the material to be separated. The radial speed is expressed in meter per second. The radial speed can be calculated according to known methods by the person skilled in the art, knowing the height and diameter of the rotating cage (hence its exchange surface) and the flow rate of the gas.

The tangential speed is the rotation speed on the periphery of the rotating cage of the separator, which transmits a centrifugal force to the particles of the material to be separated. The tangential speed is expressed by meter per second. The tangential speed can be calculated according to known methods by the person skilled in the art, knowing the diameter of the rotating cage and its rotation speed in revolutions per minute.

The present invention intends to provide at least one of the advantages listed below:

- it is possible to grind materials to finenesses greater than or equal to 7000 $cm^2/g$ Blaine Specific Surface;
- it is possible to reduce the energy required for the grinding, for example by optimising the dimension of the second mill in a grinding process carried out in two steps;
- the material to be ground can remain less time in the first and second mills, to obtain equivalent finenesses compared with known grinding units;
- in the case where the first and/or the second mills are ball mills, it is possible to reduce the grinding time even more by reducing the diameter of the balls;
- generally, when the tangential speed is increased and when the radial speed is reduced for the first and/or the second separators, it is possible to separate the particles having a smaller average size.

Finally, the invention has the advantage of being able to be used in the building industry, the cement industry or in grinding stations.

The invention relates to a grinding process of a raw material in a grinding unit comprising:

a first shop comprising a first mill and a first separator, an outlet from the first mill being connected to an inlet of the first separator;

a second shop comprising a second separator and a second mill, an outlet from the second separator being connected to an inlet of the second mill;

the second separator being fed by the material coming from the first separator, said process being characterised in that:

the first separator is operated at a tangential speed of 15 to 25 m/s and a radial speed of 3.5 to 5 m/s; and the second separator is operated at a tangential speed of 20 to 50 m/s and a radial speed of 2.5 to 4 m/s.

The process according to the present invention makes it possible to produce ultrafine materials at an industrial flow rate.

Preferably, the first separator is operated at a tangential speed of 20 to 25 m/s and a radial speed of 3.5 to 4.5 m/s.

Preferably, the second separator is operated at a tangential speed of 25 to 45 m/s and a radial speed of 3 to 3.5 m/s.

Preferably, the ratio between the tangential speed of the second separator and the tangential speed of the first separator is from 1.6 to 2.4, in particular from 1.8 to 2.2.

Preferably, the ratio between the radial speed of the first separator and the radial speed of the second separator is from 1.1 to 1.5, in particular from 1.2 to 1.4.

Preferably, the process comprises the following steps:

grinding of the raw material to be ground in the first mill to provide a first ground material;

separating of the first ground material in the first separator to provide a first fine fraction and a first coarse fraction;

re-circulating the first coarse fraction towards the first mill;

separating the first fine fraction in the second separator to provide a second fine fraction and a second coarse fraction;

storing the second fine fraction in a storage means;

grinding the second coarse fraction in the second mill to provide a second ground material;

separating the second ground material in the second separator.

The invention also relates to a process for production of a hydraulic binder comprising the following steps:

(i). grinding at least two materials with a grinding process as defined above;

(ii). mixing the materials obtained in step (i) with other optional ground or not ground materials.

Preferably, the grinding operation in step (i) is an operation during which the materials are ground separately.

The present invention also relates to a hydraulic binder comprising materials obtained by the grinding process according to the present invention.

Preferably, the materials of the hydraulic binder according to the present invention were obtained by separate grinding, which is to say that they were each ground separately in a grinding unit, which is preferably the grinding unit according to the present invention.

The invention also relates to a grinding unit, in particular for carrying out the grinding process as defined above, said unit comprising:

a first shop comprising a first mill and a first separator, an outlet from the first mill being connected to an inlet of the first separator;

a second shop comprising a second separator and a second mill, an outlet from the second separator being connected to an inlet of the second mill;

the second separator being fed by the material coming from the first separator, wherein the first separator is adapted to operate at a tangential speed of 15 to 25 m/s and a radial speed of 3.5 to 5 m/s, and the second separator is adapted to operate at a tangential speed of 20 to 50 m/s and a radial speed of 2.5 to 4 m/s.

Preferably, the first separator is adapted to operate at a tangential speed of 20 to 25 m/s and a radial speed of 3.5 to 4.5 m/s. Preferably, the second separator is adapted to operate at a tangential speed of 25 to 45 m/s and a radial speed of 3 to 3.5 m/s.

When a given separator is adapted to operate at a speed of a given range, it means that it is adapted to operate at any value of this range.

The grinding unit according to the present invention comprises two shops, which may be connected to each other or separated by an intermediary storage means. The two shops may be on the same site or on different sites. On the other hand, the two shops of the grinding unit according to the present invention may operate at the same time or at differed times. They may operate at the same flow rate of material or a different flow rates.

The first and second mills may be any known mills, for example a ball mill or a compressive mill.

According to a first embodiment, the second mill is a ball mill. A ball mill generally comprises an enclosure of cylindrical shape, in which the material to be ground is placed having a length and a diameter D. Preferably, the second mill is a ball mill comprising an enclosure of cylindrical shape having a length L, a diameter D and a L/D ratio less than or equal to 2.5, L and D being expressed in the same unit of measurement.

When the second mill is a ball mill, the length/diameter ratio (L/D) of the enclosure of the second mill is preferably less than or equal to 2, more preferably less than or equal to 1.5.

Preferably, the L/D ratio is greater than or equal to 0.65.

Preferably, the balls have an average diameter of 18 to 20 mm.

According to a second embodiment, the second mill is a compressive mill. In this respect the second shop may comprise said compressive mill and said second separator, an outlet of the separator being connected to an inlet of the mill, the separator being fed with gas by:

a first inlet of gas located at the level of the mill, the gas coming from the first inlet of gas first passing through the mill then through the separator;

a second inlet of gas located at the level of the separator, the gas coming from the second inlet of gas only passing through the separator and mixing with the gas from the first inlet of gas after its passage through the mill.

The invention also relates to a cement plant comprising a grinding unit according to the present invention connected to an inlet to a cement plant kiln.

The invention also relates to a grinding shop comprising a grinding unit according to the present invention connected to an inlet to a storage means.

The invention also relates to a use of a grinding unit according to the present invention to obtain a final ground material having a Rosin Rammler slope greater than or equal to 1.2.

The material to be ground is preferably a material used for the production of a hydraulic binder or a hydraulic composition.

The material to be ground is preferably a clinker, a hydraulic binder (for example, a cement) or a mineral addition (for example slag, fly ash, a pozzolan or limestone).

A clinker is generally the product obtained after burning (clinkerisation) of a mix (the raw meal) comprising limestone and for example, clay.

A hydraulic binder comprises any compound which sets and hardens by hydration reaction. Preferably, the hydraulic binder is a cement. A cement generally comprises one clinker and calcium sulphate. The clinker may, in particular, be a Portland clinker.

Mineral additions are generally, for example, fly ash (for example as defined in the <<Cement>> Standard NF EN 197-1 of February 2001 paragraph 5.2.4 or as defined in the <<Concrete>> Standard EN 450), pozzolanic materials (for example as defined in the <<Cement>> Standard NF EN 197-1 of February 2001 paragraph 5.2.3), silica fume (for example as defined in the <<Cement>> Standard NF EN 197-1 of February 2001 paragraph 5.2.7 or as defined in the <<Concrete>> Standard prEN 13263:1998 or NF P 18-502), slags (for example as defined in the <<Cement>> Standard NF EN 197-1 paragraph 5.2.2 or as defined in the <<Concrete>> Standard NF P 18-506), calcined shale (for example as defined in the <<Cement>> Standard NF EN 197-1 of February 2001 paragraph 5.2.5), limestone additions (for as defined in the <<Cement>> Standard NF EN 197-1 paragraph 5.2.6 or as defined in the <<Concrete>> Standard NF P 18-508) and siliceous additions (for example as defined in the <<Concrete>> Standard NF P 18-509), metakaolins or mixtures thereof.

The fineness of the final ground material may be expressed in terms of Dv97, Dv80 or Blaine Specific Surface. The Dv97 (by volume) is generally the $97^{th}$ percentile of the particle size distribution, that is to say that 97% of the particles have a size smaller than or equal to Dv97 and 3% have a size larger than Dv97. Likewise, the Dv80 (by volume) is generally the $80^{th}$ percentile of the particle size distribution, that is to say that 80% of the particles have a size smaller than or equal to Dv80 and 20% have a size larger than Dv80.

Generally, the Dv97 and Dv80 may be determined by laser granulometry for particle sizes less than 200 μm, or by sieving beforehand for particle sizes greater than 200 μm. A laser granulometry apparatus generally comprises equipment for prior treatment of the material to be analyzed to make it possible to de-agglomerate the particles of the material. Generally, de-agglomeration is carried out by ultrasound in liquid medium (for example in ethanol). When the particles tend to agglomerate it is recommended to vary the duration of the ultrasound to ensure the dispersion or to change the nature of the dispersing liquid.

The Blaine Specific Surface is determined according to the EN 196-6 Standard of August 1990, paragraph 4.

The Blaine Specific Surface of the final ground material is preferably from 7000 to 10000 $cm^2/g$.

The fineness of the ground material may be:

- for a cement of type CEM I according to the EN 197-1 Standard of February 2001, the Dv97 may be from 15 to 20 μm and the Blaine Specific Surface may be from 7000 to 10000 $cm^2/g$;
- for a limestone mineral addition, the Dv80 may be approximately 6 μm;
- for a slag, the Dv80 may be from 5 to 7 μm and the Blaine Specific Surface may be from 7000 to 10000 $cm^2/g$;
- for fly ash, the Dv97 may be approximately 7 μm.

Preferably, the Rosin Rammler slope of the final ground material is from 1.2 to 1.6, more preferably from 1.3 to 1.5.

The grinding unit and the process according to the present invention may for example make it possible to obtain hydraulic binders as described in French patent applications no 06/04398, 07/06703, 09/01364 and 11/50676.

When several materials are to be ground, the different materials to be ground may be ground together or separately.

When several materials are to be ground, the grinding process according to the present invention is preferably based on separate grinding of the materials in order to optimise the grinding for each of the materials. Known grinding processes are co-grinding processes, which in particular present problems in terms of managing the respective fineness of each material to be ground. A mix of two materials having different grindabilities does not make it possible to obtain a mix ground with satisfactory finenesses, even optimum finenesses, for each material. The easiest material to grind may be ground more finely than desired whilst the less easy material to grind may be ground more coarsely than desired. In contrast, separate grinding operations can provide the desired fineness for each material.

On the other hand, separate grinding can make it possible to customize the compositions, with controlled natures, quantities and sizes of the different materials.

Preferably, several grinding units according to the present invention may be used on the same site to grind each material separately.

The invention also relates to a ball mill, in particular a ball mill which belongs to the above grinding unit, said ball mill comprising an enclosure with a cylindrical shape having a length L, a diameter D and a L/D ratio less than or equal to 2.5, L and D being expressed in the same unit of measurement.

The invention also relates to a grinding shop, in particular a grinding shop which belongs to the above grinding unit, said shop comprising a compressive mill and a separator, an outlet of the separator being connected to an inlet of the mill, the separator being fed with gas by:

- a first inlet of gas located at the level of the mill, the gas coming from the first inlet of gas first passing through the mill then through the separator;
- a second inlet of gas located at the level of the separator, the gas coming from the second inlet of gas only passing through the separator and mixing with the gas from the first inlet of gas after its passage through the mill.

The embodiments presented above are described in more detail in the following description, in relation to the following figures.

Figure 1:
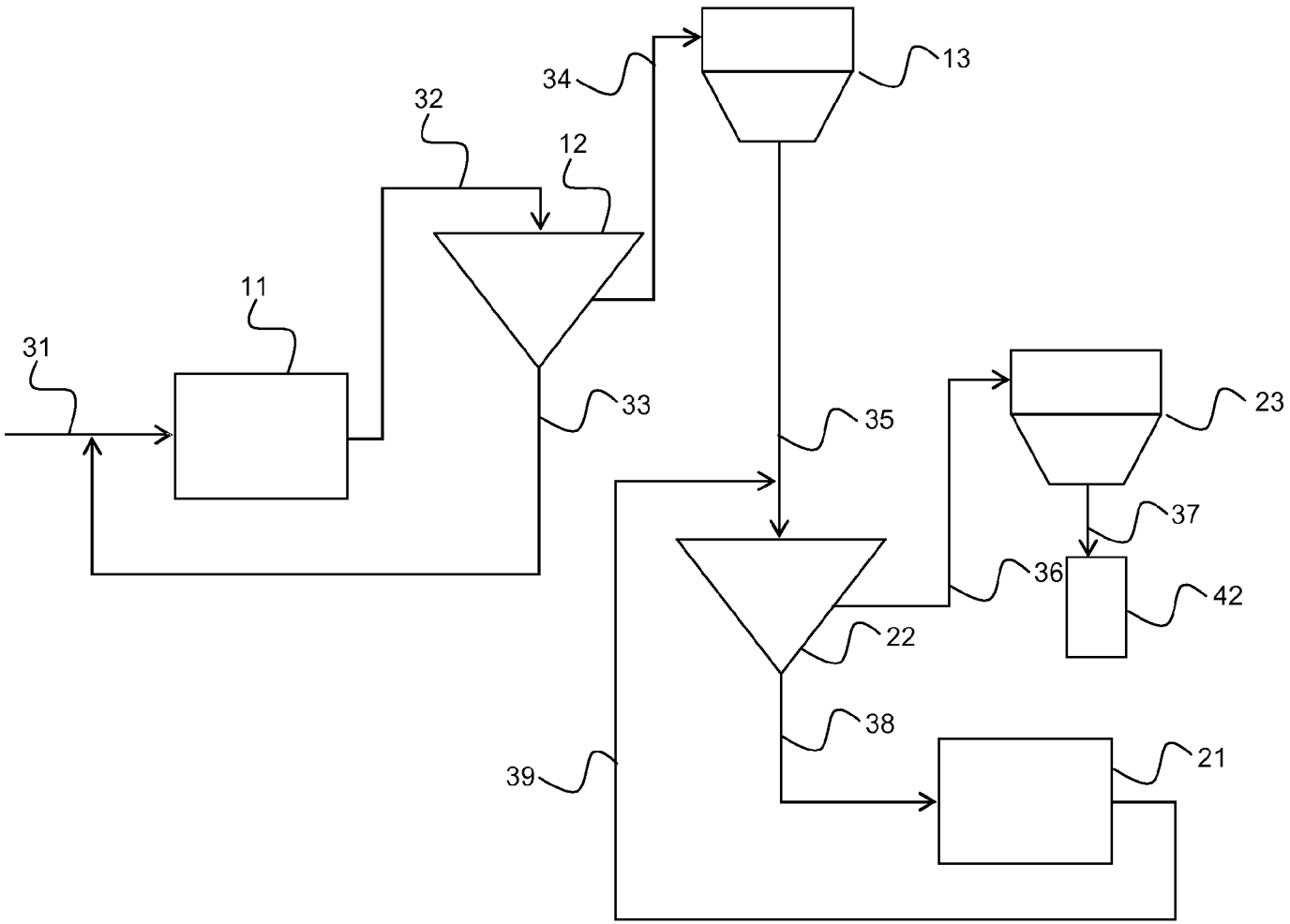
FIG. 1 represents an embodiment of a grinding unit according to the present invention.

According to FIG. 1, the grinding unit comprises a first shop and a second shop. The first shop comprises a first mill 11, a first separator 12 and a first filter 13. The second shop comprises a second mill 21, a second separator 22 and a second filter 23. The first mill 11 is fed with material to be ground by a first conveying means 31. An outlet of the first mill 11 is connected to an inlet of the first separator 12 by a second conveying means 32. A first outlet of the first separator 12 is connected to an inlet of the first mill by a third conveying means 33. A second outlet of the first separator 12 is connected to an inlet of the first filter 13 by a fourth conveying means 34. An outlet of the first filter 13 is connected to an inlet of the second separator 22 by a fifth conveying means 35. A first outlet of the second separator 22 is connected to an inlet of the second filter 23 by a sixth conveying means 36. An outlet of the second filter 23 is connected to a storage means 42 by a seventh conveying means 37. A second outlet of the second separator 22 is connected to an inlet of the second mill 21 by an eighth conveying means 38. An outlet of the second mill 21 is connected to the inlet of the second separator 22 by a ninth conveying means 39.

The conveying means may be any known conveying means, and for example a conveyor belt, a continuous screw or a truck.

The operating procedure of the embodiment of a grinding unit according to FIG. 1 is the following. The raw material is ground in the first mill 11 to provide a first ground material. The first ground material is separated in the first separator 12 to provide a first fine fraction and a first coarse fraction. The first coarse fraction is then ground in the first mill 11. The first filter 13 is fed by the first fine fraction. The first filter 13 makes it possible to filter the transporting gas of the first separator 12 to provide a first filtered fine fraction. The first filtered fine fraction is separated in the second separator 22 to provide a second fine fraction and a second coarse fraction. The second filter 23 is fed by the second fine fraction. The second filter 23 makes it possible to filter the transporting gas of the second separator 22 to provide a second filtered fine fraction. The second filtered fine fraction is stored in the storage means 42. The second coarse fraction is ground in the second mill 21 to provide a second ground material. The second ground material is separated in the second separator 22.

Figure 2:
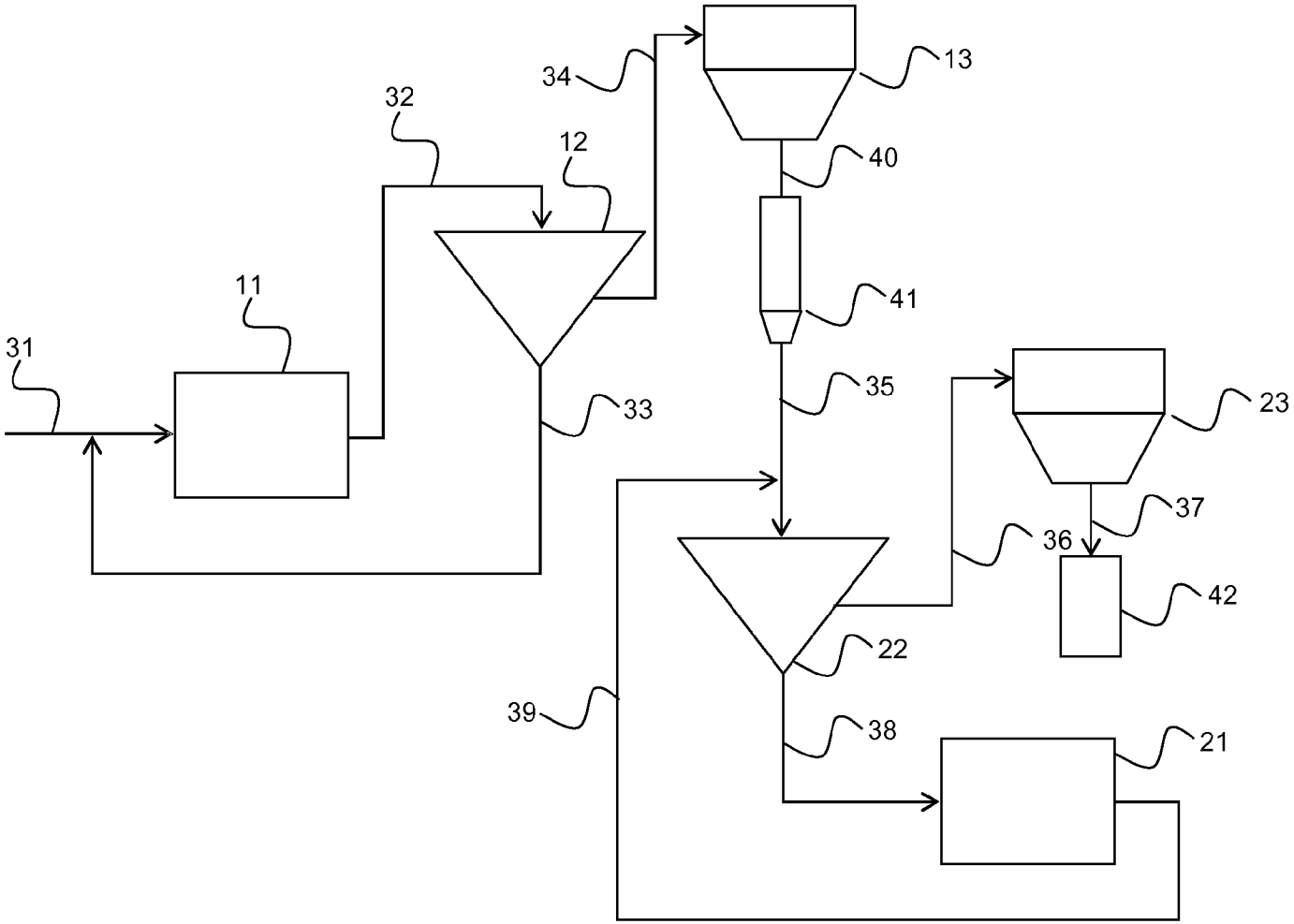
FIG. 2 represents another embodiment of a grinding unit according to the present invention.

According to FIG. 2, which represents a variant of the process represented in FIG. 1, the grinding unit may further comprise a storage means 41, which may be a silo, located between the first filter 13 and the second separator 22. The outlet of the first filter 13 is connected to an inlet of the storage means 41 by a tenth conveying means 40. An outlet of the storage means 41 is connected to the inlet of the second separator 22 by the fifth conveying means 35.

The operating procedure of the embodiment of a grinding unit according to FIG. 2 is the following. After passage through the first filter 13, the first filtered fine fraction is stored in the storage means 41. This may in particular be the case when two shops do not operate at the same time, do not operate at the same flow rate or are not on the same site. In the latter case, the fifth and/or tenth conveying means 35, 40 is a truck.

By way of example, the raw materials to be ground may have a particle size less than or equal to 50 mm. The first filtered fine fraction may have a particle size less than or equal to 63 μm, a Blaine Specific Surface of approximately 3960 $cm^2/g$ and a Rosin Rammler slope of approximately 1.02. The second filtered fine fraction may have a particle size less than or equal to 20 μm, a Blaine Specific Surface of approximately 8000 $cm^2/g$ and a Rosin Rammler slope greater than or equal to 1.2.

By way of example, the flow rate of the first filtered fine fraction provided by the first filter 13 may be approximately 100 t/h. The flow rate of the second filtered fine fraction provided by the second filter 23 may be approximately 50 t/h.

Figure 3:
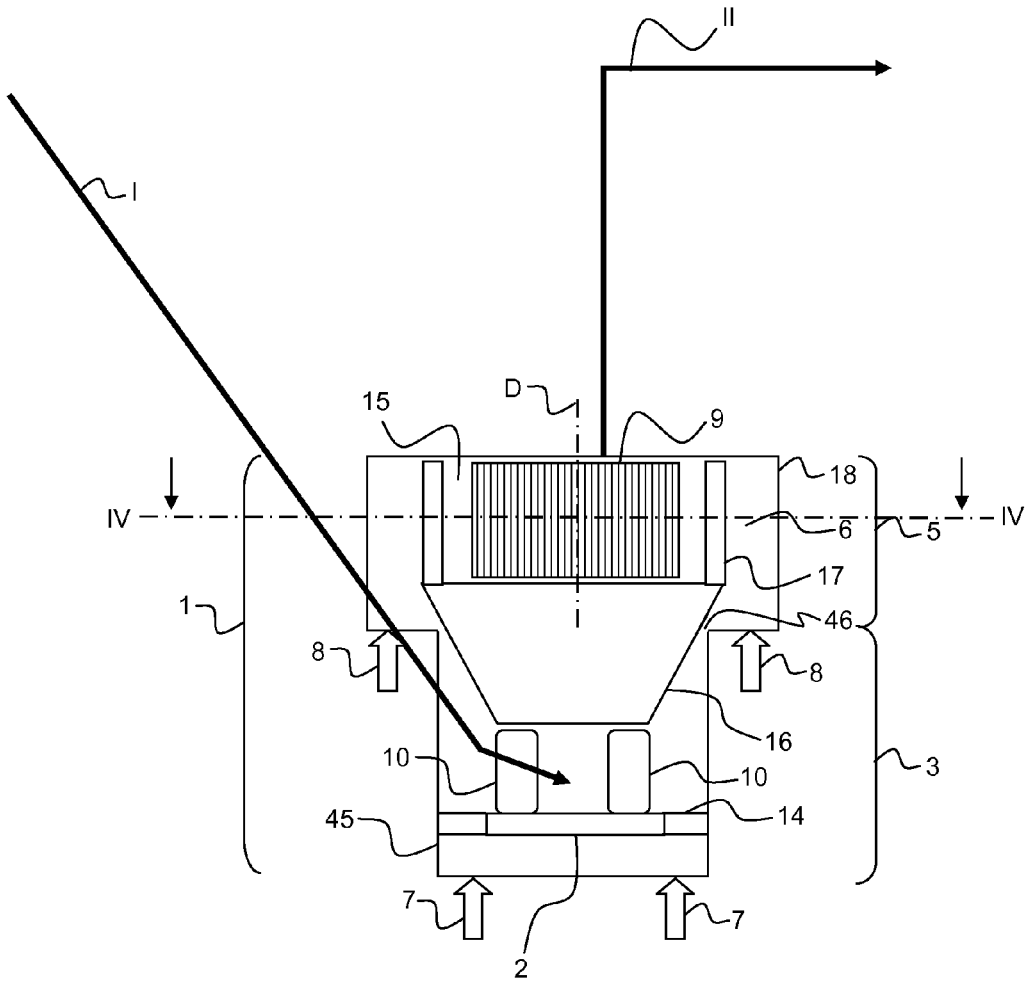
FIG. 3 is a side view with a cross section of a mill and a separator which belong to the grinding unit according to the present invention.
Figure 4:
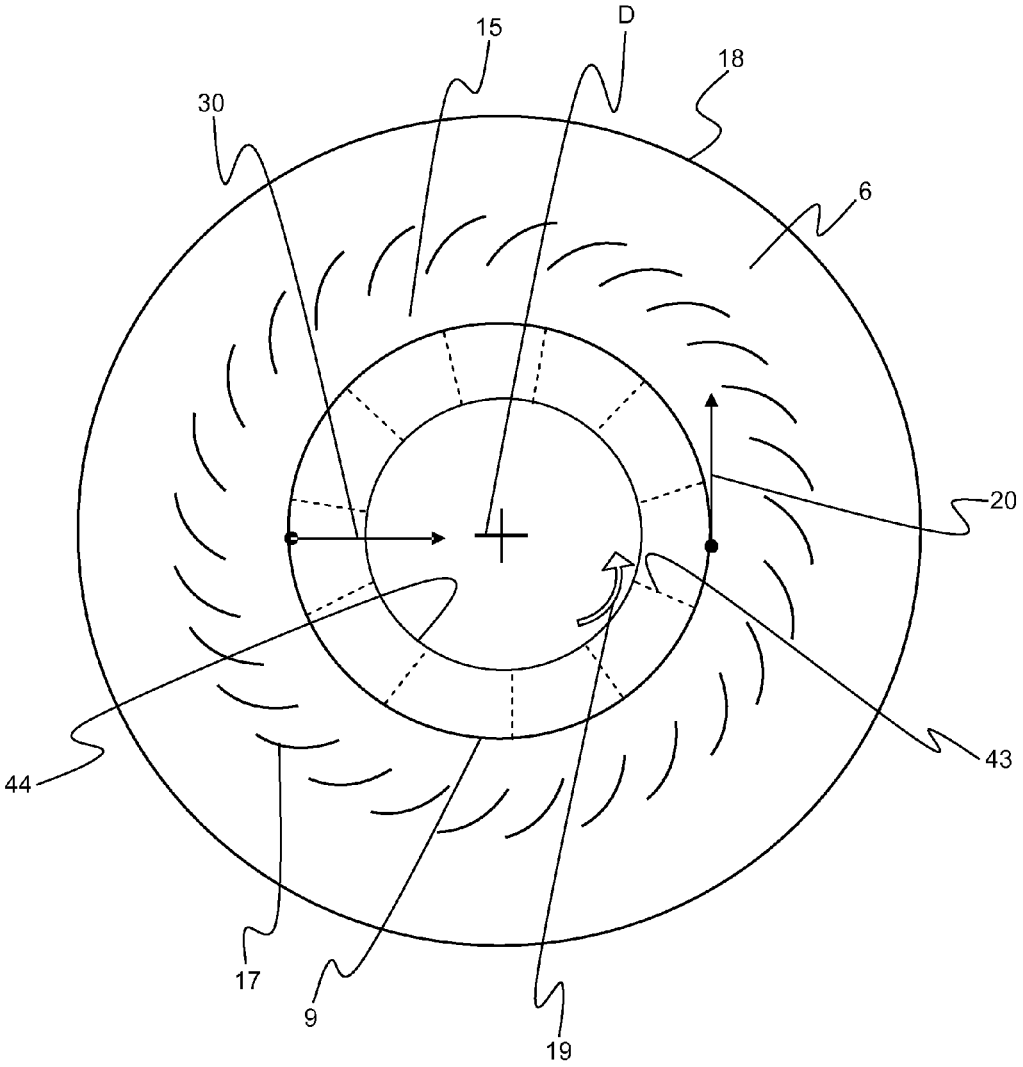
FIG. 4 is a cross section along line IV-IV on FIG. 3.

According to the embodiment of FIGS. 3 and 4 the second mill is a compressive mill 3 connected to the second separator 5. The mill comprises an enclosure 45 in which a cylindrical grinding table 2 on a vertical axis is placed, surrounded by a louver ring 14 which comprises guiding means of the flow of gas in the vertical direction. Rollers 10 are placed at the periphery of the table 2. The axis of the rollers 10 is positioned radially relative to the table 2. A cone 16 connects the mill 3 and the separator 5. The mill 3 also comprises a first inlet of gas 7, located at the bottom of the mill 3 which emerges in the louver ring 14. The louver ring 14 is connected to the first inlet of gas 7. A means I of supplying material to be ground makes it possible to feed the mill 3 with material to be ground.

The separator 5 comprises a fixed enclosure 18 on a vertical axis on which a rotating cage 9 and vanes 17 are placed vertically. The vanes 17 are placed in a circle around the rotating cage 9. They cover the entire height of the rotating cage 9. The rotating cage 9 comprises blades 43 which are fixed between the bottom massive disk and a top hollow disk 44. Each blade 43 is oriented radially and extend out in a substantially vertical direction over the entire height of the rotating cage 9. The blades 43 do not join together at the centre of the rotating cage 9. A selection zone 15 corresponds to the space between the rotating cage 9 and the vanes 17. A feeding zone 6 of gas and particles of a material to be separated corresponds to the space between the cylindrical enclosure 18 and the vanes 17. The top end of the enclosure 45 of the mill 3 emerges in the feeding zone 6 through a passage 46. The separator further comprises a second inlet of gas 8. The second inlet of gas 8 is located at the level of the enclosure 18 of the separator 5. The second inlet of gas 8 may be in the form of Variable Inlet Vanes, the position of which is adjustable to adjust the additional flow of gas. A conveying means II makes it possible to evacuate the final ground material from the separator 5.

When in operation, the material to be ground is fed by the supply means I at the centre of the table 2 of the mill 3. The table 2 turns around its axis during the grinding operation. The rotation speed of the table 2 of the mill 3 may be set or be adjustable. The material moves from the centre of the table 2 towards the outer part of the table 2 during the grinding operation.

The rollers 10 turn around their horizontal axis. The rollers 10 may have different shapes, for example cylindrical, ring or truncated shapes. The rollers 10 exert pressure on the table 2 whilst they roll on the table 2 to grind the material to be ground. The rollers 10 are put under pressure by a hydraulic system (operating, for example with oil).

The material to be ground entering the ring zone 14 is transported by the gas from the first inlet 7 at the end of the table 2 towards the feeding zone 6 of the separator 5 through the passage 46. The total flow rate of gas in the feeding zone 6 comprises two different flow rates of gas: the flow rate of gas from the first inlet 7 coming from the mill 3 and an additional flow rate of gas coming from the second inlet 8 coming from exterior air inlets located at the level of the separator 5.

The rotating cage 9 turns around its vertical axis D in the direction given by the arrow 19. This rotation creates a tangential speed represented by the arrow 20. The vanes 17 are fixed, which is to say that they do not turn around the vertical axis D of the rotating cage 9. The vanes 17 can be oriented, rotating around themselves, to adjust the speed of the gas to the rotation speed of the rotating cage 9. The mix of gas coming from the first inlet 7 and the second inlet 8, which carries the particles of the material to be separated, arrives by the bottom of the separator and rises in a substantially vertical direction in the feeding zone 6. It is diverted by the vanes 17, in order to pass through the selection zone 15 and reach the blades 43 of the rotating cage 9 in a substantially radial movement, which is to say in the direction of the vertical D axis. The gas escapes from the rotating cage 9 in a rising movement, through an opening which is substantially at the centre of the rotating cage 9 which is generally connected to an aspiration means (not represented). The particles entrained by the gas reach the rotating cage 9 at a radial speed represented by the arrow 30.

The additional flow of gas from the second inlet 8 makes it possible to adjust the total flow of gas in the feeding zone 6 and hence the flow of gas in the selection zone 15. This total flow of gas comprising the flow of gas from the first inlet 7 and the additional flow of gas from the second inlet 8 induces the radial speed. The tangential speed is determined by the rotation speed of the rotating cage 9 of the separator 5. The combination of the tangential and radial speeds defines the cut size and the fineness of the final ground material. The sufficiently small particles are entrained by the gas, then they rise in a substantially vertical direction with the gas. The particles which are too big fall into the selection zone 15 by the action of gravity. The particles which are too big, which fall into the selection zone 15 are recovered in the cone 16, which sends the particles which are too big to the table 2 of the mill 3. The fine particles are directed towards the conveying means II of the final ground material, which is generally connected to a means of aspiration and to a storage means.

In the above paragraphs related to FIGS. 3 and 4, reference is made to a compressive mill, used as second mill according to the invention. However, this compressive mill may be replaced by a ball mill. In particular, this ball mill may comprise an enclosure of cylindrical shape having a length L, a diameter D and a L/D ratio less than or equal to 2.5.

When use is made of a ball mill, the associated separator may have the same structure as that of separator 5 described in FIGS. 3 and 4. Moreover, this separator associated to a ball mill may be operated in the same way, as that above described in reference to separator 5 associated to a compressive mill. Moreover, whatever the nature of second mill, a compressive mill or a ball mill may be used as first mill.

EXAMPLES

Example 1

Comparison of Different Grinding Shops

Different grinding shops were compared. Each of the mills presented below was associated to a separator.

Test 1 was carried out in the conditions described below. The material to be ground was a cement of type CEM I 52,5 N from the Lafarge cement plant of Saint Pierre La Cour. The grinding unit comprised a first shop comprising a first ball mill and a first separator, an outlet of the first mill being connected to an inlet of the first separator; and a second shop comprising a second separator and a second ball mill, an outlet of the second separator being connected to an inlet of the second mill; the second separator being fed by the material from the first separator. The first mill had two compartments. The first compartment of the first mill had a filling rate of balls of 30% by volume and comprised balls having a diameter of 60 to 90 mm. The second compartment of the first mill had a filling rate of balls of 32% by volume and comprised balls having a diameter of 20 to 50 mm. The second mill had a compartment having a filling rate of balls of 24% by volume and comprising balls having a diameter of 18 to 20 mm. The cement obtained after passage through the first mill had a Blaine Specific Surface of Blaine of 3500 $cm^2/g$. The cement obtained after passage through the second mill had the characteristics presented in Table 1 below.

Test 2 was carried out in the conditions described below. The material to be ground was a cement of type CEM I 52,5 N from the Lafarge cement plant of Saint Pierre La Cour. The grinding unit comprised a first shop comprising a first ball mill and a first separator, an outlet of the first mill being connected to an inlet of the first separator; and a second shop comprising a second separator and a second ball mill, an outlet of the second separator being connected to an inlet of the second mill; the second separator being fed by the material from the first separator. The first mill had two compartments. The first compartment of the first mill had a filling rate of balls of 30% by volume and comprised balls having a diameter of 60 to 90 mm. The second compartment of the first mill had a filling rate of balls of 32% by volume and comprised balls having a diameter of 20 to 50 mm. The second mill had a compartment having a filling rate of balls of 24% by volume and comprising balls having a diameter of 18 to 20 mm. The cement obtained after passage through the first mill had a Blaine Specific Surface of 3500 $cm^2/g$. The cement obtained after passage through the second mill had the characteristics presented in Table 1 below.

Test 3 was carried out in the conditions described below. The material to be ground was a cement of type CEM I 52,5 R from the Lafarge cement plant of La Couronne. The grinding unit comprised a shop comprising a ball mill and a separator, an outlet of the mill being connected to an inlet of the separator. The mill had two compartments. The first compartment of the mill had a filling rate of balls of 30% by volume and comprised balls having a diameter of 60 to 90 mm. The second compartment of the mill had a filling rate of balls of 32% by volume and comprised balls having a diameter of 20 to 50 mm. The cement obtained after passage through the mill had the characteristics presented in Table 1 below.

Table 1 below presents the obtained results. The first separator had a tangential speed of 15 to 25 m/s and a radial speed of 3.5 to 5 m/s in Test 1 and Test 2, which corresponds to the speeds defined according to the invention.

TABLE 1

Comparison of the different grinding shops

| | Test 1 | Test 2 | Test 3 |
|---|---|---|---|
| Tangential speed of the first separator | 15 to 25 m/s | 15 to 25 m/s | — |
| Radial speed of the first separator | 3.5 to 5 m/s | 3.5 to 5 m/s | — |
| Tangential speed of the second separator | 30.4 m/s | 29.3 m/s | 25.0 m/s |
| Radial speed of the second separator | 3.5 m/s | 3.5 m/s | 3.9 m/s |
| Blaine Specific Surface of the final ground cement | 9 300 $cm^2/g$ | 8 400 $cm^2/g$ | 4 400 $cm^2/g$ |
| nRR slope of the final ground cement | 1.50 | 1.39 | 0.97 |

The nRR slope is the Rosin Rammler slope.

According to Table 1 above, Test 1 and Test 2 each comprised two grinding steps and tangential and radial speeds for the first and the second separators corresponding to those defined according to the invention (for the first separator a tangential speed of 15 to 25 m/s and a radial speed of 3.5 to 5 m/s; for the second separator, respectively a tangential speed of 30.4 m/s and a radial speed of 3.5 m/s for Test 1, and a tangential speed of 29.3 m/s and a radial speed of 3.5 m/s for Test 2). Test 1 and Test 2 produced a material having a Blaine Specific Surface greater than or equal to 7000 $cm^2/g$ (respectively 9300 $cm^2/g$ for Test 1 and 8400 $cm^2/g$ for Test 2) and having a nRR slope greater than or equal to 1.2 (respectively 1.50 for Test 1 and 1.39 for Test 2).

Test 3 comprised one single grinding step. It was not possible to obtain a ground material having a Blaine Specific Surface greater than or equal to 7000 $cm^2/g$ (4400 $cm^2/g$) and having a nRR slope greater than or equal to 1.2 (0.97) in Test 3.

Example 2

Comparison of the Ball Mills

Several ball mills were compared. The ball mills had a cylindrical enclosure having different L/D ratios, L being the length and D being the diameter.

The grinding unit comprised a first shop comprising a first ball mill and a first separator, an outlet of the first mill being connected to an inlet of the first separator; a second shop comprising a second separator and a second ball mill, an outlet of the second separator being connected to an inlet of the second mill; the second separator being fed by the material from the first separator.

Only certain operating parameters of the second shop are presented in Table 2 below. For Tests 1-1 to 4-1, the material fed into the first shop was a mix of clinker, limestone and gypsum having a particle size less than or equal to 50 mm. The composition of the mix was 90% by mass of clinker, 5% by mass of gypsum and 5% by mass of limestone. The material leaving the first shop was a cement of type CEM I according to the EN 197-1 Standard of February 2001 having a Blaine Specific Surface of 3960 $cm^2/g$ and a Rosin Rammler (nRR) slope of 1.02.

The material fed into the first shop in the comparative test was a cement of type CEM I according to the EN 197-1 Standard of February 2001. The material leaving the first shop had a Blaine Specific Surface of 3400 $cm^2/g$ and a Rosin Rammler (nRR) slope of 0.99.

TABLE 2

Conditions and results obtained for the grinding process in the second shop

| Second shop | Filling rate of balls (%) | Size of the balls (mm) | L/D | Blaine Specific Surface ($cm^2/g$) | Specific energy of the second mill kWh/t (2) | nRR slope |
|---|---|---|---|---|---|---|
| Test 1-1 | 29 | 18-20 | 0.70 | 7540 | 53 | 1.47 |
| Test 1-2 | | | 1.40 | 7030 | 51 | 1.44 |
| Test 2-1 | 24 | 18-20 | 0.70 | 7250 | 51 | 1.40 |
| Test 2-2 | | | 1.40 | 7370 | 49 | 1.31 |
| Test 3-1 | 17 | 18-20 | 0.70 | 8800 | 79 | 1.48 |
| Test 3-2 | | | 1.40 | 8280 | 71 | 1.59 |
| Test 4-1 | 25 | 12.7 | 0.70 | 7250 | 47 | 1.36 |
| Comparative test | 28 | >25 | 2.9 | 5250 | x | 0.87 |

The nRR slope is the Rosin Rammler slope.

The specific energy corresponds to the grinding energy per ton of raw material and is given in kWh/t.

According to Table 2 above, the different tests which were carried out in a ball mill comprising an enclosure having a L/D diameter less than or equal to 2 (tests 1-1 to 4-1) made it possible to obtain a ground material having a Blaine Specific Surface greater than or equal to 7000 $cm^2/g$ and a Rosin Rammler slope greater than or equal to 1.2.

The optimum value of the L/D ratio in the conditions of the example was approximately 1.4, and the optimum value of the filling rate of the mill was from 23 to 24% by volume.

However, a satisfactory solution was tested with a ball mill comprising balls having an average diameter of 12.7 mm, a filling rate of balls of 24% and a L/D ratio of 0.7.

The comparative test was carried out in a ball mill comprising an enclosure having a L/D ratio of 2.9. The obtained ground material had a Blaine Specific Surface of 5250 $cm^2/g$ and a Rosin Rammler slope of only 0.87.

Table 3 below presents a comparison in terms of energy required for the grinding.

TABLE 3

Comparison of energies required for the grinding

| | Blaine Specific Surface ($cm^2/g$) | Specific energy of the first mill kWh/t (1) | Specific energy of the second mill kWh/t (2) | Total specific energy for grinding total kWh/t | Specific energy for grinding in one single step total kWh/t |
|---|---|---|---|---|---|
| Test 1-2 | 7030 | 41 | 51 | 92 | 104 |
| Test 3-2 | 8280 | 41 | 71 | 112 | 148 |

The specific energy expressed in kWh/t (1) in Table 3 above, corresponded to the grinding energy per tonne of raw material for the first ball mill, which is to say, the grinding operation of the mix described above having a particle size less than or equal to 50 mm. The specific energy expressed in kWh/t (2) corresponded to the grinding energy per tonne of raw material for the second ball mill, which is to say the grinding operation of the cement initially having a Blaine Specific Surface of 3960 $cm^2/g$ to obtain the fineness values described in the second column of Table 3.

To conclude, the grinding operation in one single step using a ball mill comprising an enclosure having a L/D ratio of 3 to 3.5 (refer to column six in Table 3) consumed more specific energy than the grinding operation in two steps. For example, the specific grinding energy was 104 kWh/t to produce a cement having a Blaine Specific Surface of 7030 $cm^2/g$ in one grinding step whilst it was 92 kWh/t in two grinding steps.

The invention claimed is:

1. A grinding process of a raw material in a grinding unit, said unit including a first shop comprising a first mill and a first separator, an outlet from the first mill being connected to an inlet of the first separator, a second shop comprising a second separator and a second mill, an outlet from the second separator being connected to an inlet of the second mill, the second separator being fed by the material coming from the first separator, said grinding process comprising:

operating the first separator at a tangential speed of 15 to 25 m/s and a radial speed of 3.5 to 5 m/s; and operating the second separator at a tangential speed of 20 to 50 m/s and a radial speed of 2.5 to 4 m/s.

2. The grinding process according to claim 1, wherein the first separator is operated at a tangential speed of 20 to 25 m/s and a radial speed of 3.5 to 4.5 m/s.

3. The grinding process according to claim 1, wherein the second separator is operated at a tangential speed of 25 to 45 m/s and a radial speed of 3 to 3.5 m/s.

4. The grinding process according to claim 1, wherein the ratio between the tangential speed of the second separator and the tangential speed of the first separator is from 1.6 to 2.4.

5. The grinding process according to claim 4, wherein the ratio between the tangential speed of the second separator and the tangential speed of the first separator is from 1.8 to 2.2.

6. The grinding process according to claim 1, wherein the ratio between the radial speed of the first separator and the radial speed of the second separator is from 1.1 to 1.5.

7. The grinding process according to claim 6, wherein the ratio between the radial speed of the first separator and the radial speed of the second separator is from 1.2 to 1.4.

8. The grinding process according to claim 1, comprising:

a) grinding of the raw material to he ground in the first mill to provide a first ground material;

b) separating of the first ground material in the first separator to provide a first fine fraction and a first coarse fraction;

c) re-circulating the first coarse fraction towards the first mill;

d) separating the first fine fraction in the second separator to provide a second fine fraction and a second coarse fraction;

e) storing the second fine fraction in a storage means;

f) grinding the second coarse fraction in the second mill to provide a second ground material;

g) separating the second ground material in the second separator.

9. A process for production of a hydraulic binder comprising:

(i) grinding at least two materials with a grinding process according to claim 1;

(ii) mixing the materials obtained in step (i) with other optional ground or not ground materials.

10. The process according to claim 9, wherein the grinding operation in step (i) is an operation during which the materials are ground separately.

11. A grinding unit for carrying out a grinding process of a raw material, said grinding unit comprising:

a first shop comprising a first mill and a first separator, an outlet from the first mill being connected to an inlet of the first separator;

a second shop comprising a second separator and a second mill, an outlet from the second separator being connected to an inlet of the second mill;

the second separator being fed by the material coming from the first separator, wherein the first separator is configured to operate at a tangential speed of 15 to 25 m/s and a radial speed of 3.5 to 5 m/s and the second separator is configured to operate at a tangential speed of 20 to 50 m/s and a radial speed of 2.5 to 4 m/s.

12. The grinding unit according to claim 11, wherein the second mill is a ball mill comprising an enclosure of cylindrical shape having a length L, a diameter D and a L/D ratio less than or equal to 2.5, L and D being expressed in the same unit of measurement.

13. The grinding unit according to claim 11, wherein the second shop comprises a compressive mill as second mill, and said second separator, an outlet of the separator being connected to an inlet of the compressive mill, the separator being fed with gas by:

a first inlet of gas located at the level of the compressive mill, the gas coming from the first inlet of gas first passing through the mill then through the separator;

a second inlet of gas located at the level of the separator, the gas coming from the second inlet of gas only passing through the separator and mixing with the gas from the first inlet of gas after its passage through the compressive mill.

14. A cement plant comprising a grinding unit according to claim 11, connected to an inlet of a cement plant kiln.

* * * * *